US007228844B2

(12) United States Patent
Ricco et al.

(10) Patent No.: US 7,228,844 B2
(45) Date of Patent: Jun. 12, 2007

(54) INTERNAL COMBUSTION ENGINE STORAGE-VOLUME FUEL INJECTION SYSTEM

(75) Inventors: Mario Ricco, Valenzano (IT); Sisto Luigi De Matthaeis, Valenzano (IT); Raffaele Ricco, Valenzano (IT); Domenico Lepore, Valenzano (IT)

(73) Assignee: C.R.F. Societa Consortile Per Azioni, Orbassano (IT)

( * ) Notice: Subject to any disclaimer, the term of this patent is extended or adjusted under 35 U.S.C. 154(b) by 0 days.

(21) Appl. No.: 11/111,744

(22) Filed: Apr. 22, 2005

(65) Prior Publication Data

US 2006/0137658 A1 Jun. 29, 2006

(30) Foreign Application Priority Data

Dec. 23, 2004 (EP) ..... 04425945

(51) Int. Cl.
*F02M 37/04* (2006.01)

(52) U.S. Cl. ..... 123/446; 123/456

(58) Field of Classification Search ..... 123/504, 123/446, 447, 456, 514, 500, 501, 506
See application file for complete search history.

(56) References Cited

U.S. PATENT DOCUMENTS 5,676,114 A * 10/1997 Tarr et al. ..... 123/446
6,293,253 B1 * 9/2001 Arnold et al. ..... 123/458
6,408,823 B1 * 6/2002 Takahashi et al. ..... 123/456
6,609,500 B2 * 8/2003 Ricco et al. ..... 123/446
6,899,084 B2 * 5/2005 Miyashita ..... 123/446
6,976,473 B2 * 12/2005 Boos et al. ..... 123/446
2001/0022171 A1 * 9/2001 Gaessler et al. ..... 123/446
2002/0092503 A1 * 7/2002 Ricco ..... 123/446
2002/0096145 A1 * 7/2002 Ricco et al. ..... 123/446
2005/0126539 A1 * 6/2005 Okamoto ..... 123/446

FOREIGN PATENT DOCUMENTS

| | | |
|---|---|---|
| DE | 103 45 154 A1 | 4/2004 |
| EP | 1 219 827 A1 | 7/2002 |
| EP | 1 241 338 A2 | 9/2002 |
| EP | 1 382 827 A2 | 1/2004 |
| EP | 1 469 190 A1 | 10/2004 |
| FR | 2 845 132 A1 | 4/2004 |

* cited by examiner

*Primary Examiner*—Carl S. Miller
(74) *Attorney, Agent, or Firm*—Jacobson Holman PLLC

(57) ABSTRACT

The injection system has a pump for supplying high-pressure fuel to a storage volume for supplying a number of injectors. The pump has at least one reciprocating pumping element performing a compression stroke synchronously with each fuel injection. The injection system has at least one control device for controlling the amount of fuel supplied by the pump to the storage volume, and which is controlled by a chopper control unit to modulate the fuel volume introduced into the compression chamber during the intake stroke (Ps-Pi). The delivery start instant of the pumping element during the compression stroke being unequivocally defined by the fuel volume introduced.

17 Claims, 4 Drawing Sheets

INTERNAL COMBUSTION ENGINE STORAGE-VOLUME FUEL INJECTION SYSTEM

BACKGROUND OF THE INVENTION

1. Field of the Invention

The present invention relates to an internal combustion engine storage-volume fuel injection system.

2. Description of the Related Art

Modern internal combustion engine fuel injection systems normally comprise a pump for supplying high-pressure fuel to a common rail having a given fuel storage volume and for supplying a number of engine cylinder injectors. The pump comprises at least one reciprocating pumping element performing each time an intake stroke and a compression or delivery stroke.

As is known, for it to be atomized properly, the fuel must be brought to extremely high pressure, e.g. in the region of 1600 bars in maximum engine load conditions. Current regulations governing pollution by engine exhaust gas require that the fuel feed pressure to the injectors be reproducible as accurately as possible with respect to the electronic central control unit map. Pressure fluctuations, in the common rail, with respect to the set pressure can be limited if the volume of the common rail is over order of magnitude of the fuel quantity drawn by each injector per combustion cycle. Such a common rail, however, is invariably bulky and therefore difficult to accommodate on the engine.

To control pressure in the common rail as mapped in the central control unit, it has been proposed to fit, along the pump delivery conduit to the common rail, a bypass solenoid valve controlled by an electronic unit as a function of various engine operating parameters. It has also been proposed to operate the pumping element by means of cam operating synchronously with each injector.

In known systems of this sort, each pumping element has an instantaneous flow, the maximum value of which is less than the maximum value of each injector, so that, during each injection, only part of the injected fuel, about 20%, is normally supplied by the pump, the rest being supplied by the common rail. Systems of this sort therefore have the drawback of necessarily requiring a common rail of suitable size. Moreover, the pump operates permanently at the maximum flow rate, while the bypass solenoid valves simply provides for draining the surplus pumped fuel, in excess of that drawn by the injectors, into the tank, thus dissipating heat.

SUMMARY OF THE INVENTION

It is an object of the invention to provide a fuel injection system, which is highly reliable and eliminates the drawbacks of known systems by optimizing performance and minimizing the fuel storage volume between the pump and injectors.

According to the present invention, there is provided an internal combustion engine fuel injection system for an internal combustion engine having a number of cylinders, the injection system including a pump for supplying high-pressure fuel to a storage volume, and a number of injectors supplied by the storage volume and each activated to perform an injection of pressurized fuel into a corresponding cylinder of the engine. The injection has a maximum pressurized fuel flow depending on the operating conditions of the engine. The pump includes at least one reciprocating pumping element performing an intake stroke (Ps-Pi) and a compression stroke (Pi-Ps) for each of the injections, and a control device is provided to vary the quantity of fuel supplied by the pump to the storage volume. The pumping element has a maximum instantaneous flow greater than the maximum flow of each of the injectors. More specifically, the flow control device includes an on-off solenoid valve along the intake conduit of the pumping element, the maximum instantaneous flow of which is greater than the maximum flow of each injector, and the solenoid valve is controlled by a chopper control unit synchronously with the intake stroke (Ps-Pi).

The chopper control unit provides for pulse-width-modulation (PWM) control of the on-off solenoid valve with a pumping element intake start instant and end instant, so as to control the fuel volume fed into the compression chamber by modulating both the instant the solenoid valve opens and the instant it closes.

The present invention also relates to a high-pressure pump for pumping fuel to a storage volume supplying a number of fuel injectors. The pump includes at least one reciprocating pumping element performing an intake stroke (Ps-Pi) and a compression stroke (Pi-Ps). the pumping element having a compression chamber communicating with an intake conduit and a delivery conduit. An on-off solenoid valve is provided along the intake conduit to control the amount of fuel introduced into the compression chamber of the pumping element which has a maximum instantaneous flow greater than the maximum flow of each of the injectors. The on-off solenoid valve is controlled to unequivocally define the fuel volume introduced into the compression chamber, and consequently the delivery start instant of the pumping element.

The Present invention also relates to a method of controlling the fuel pressure in a storage volume for a number of fuel injectors. The method includes the steps of providing a pumping element having a flow greater than the maximum flow of the injector, providing an on-off solenoid valve along an intake conduit of the pumping element, activating the pumping element synchronously with each of the injections, and controlling the on-off solenoid valve to modulate the fuel volume introduced into the pumping compression chamber during the intake stroke, and consequently the delivery start instant of the pumping element

BRIEF DESCRIPTION OF THE DRAWINGS

A number of preferred, non-limiting embodiments of the invention will be described by way of example with reference to the accompanying drawings, in which.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
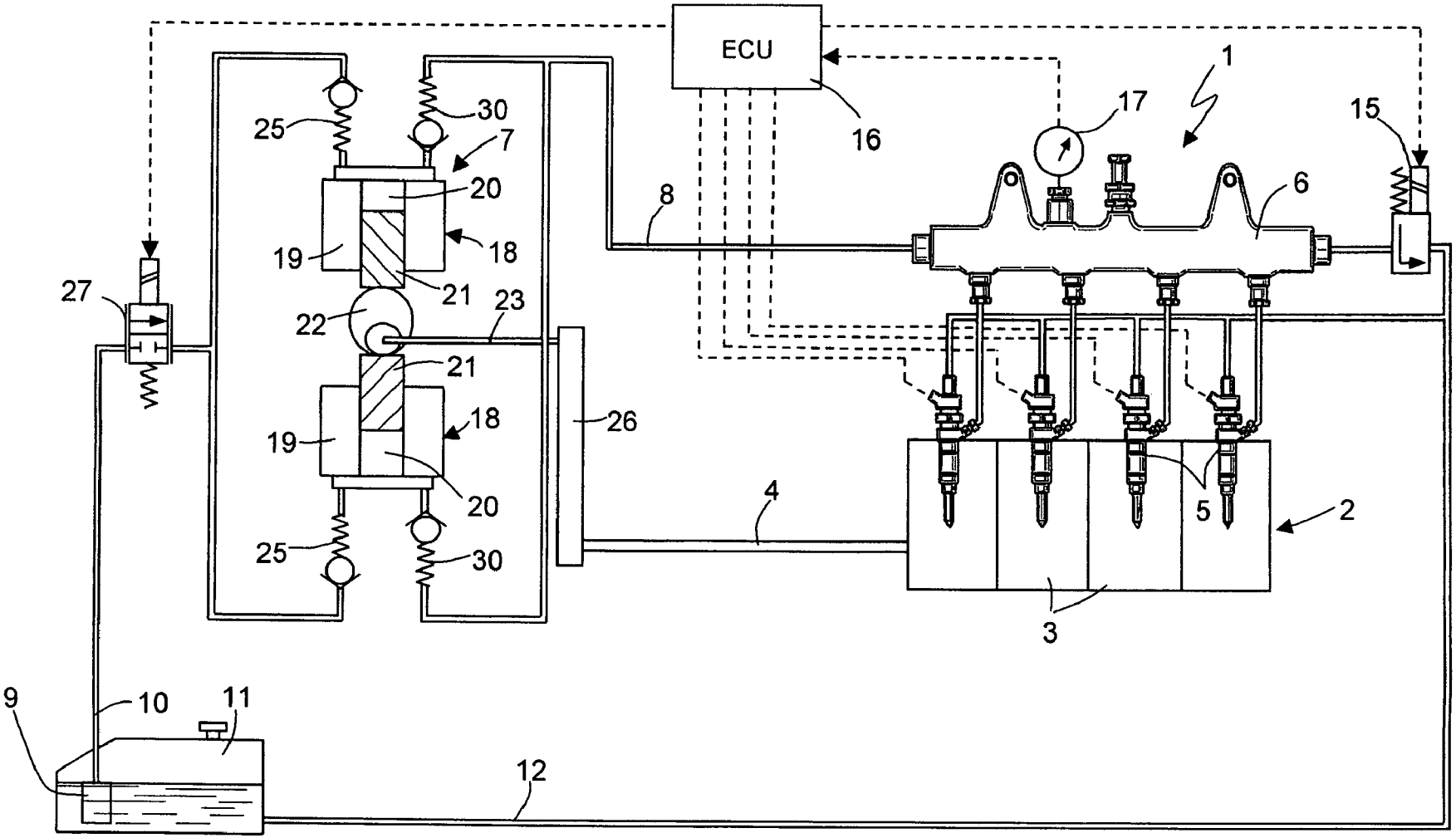
FIG. 1 shows a diagram of a common-rail fuel injection system in accordance with the present invention.

Number 1 in FIG. 1 indicates as a whole a common-rail fuel injection system for an internal combustion, e.g. diesel, engine 2 comprising a number of, e.g. four, cylinders 3, which cooperate with corresponding pistons (not shown) for rotating a drive shaft 4.

Injection system 1 comprises a number of electrically controlled injectors 5 associated with and for injecting high-pressure fuel into cylinders 3. Injectors 5 are connected to a storage volume having a given volume for one or more injectors 5.

In the FIG. 1 embodiment, the storage volume is defined by a common rail 6, to which injectors 5 are all connected, and which is supplied by a high-pressure pump, indicated as a whole by 7, with high-pressure fuel along a high-pressure delivery conduit 8. The storage volume may also be distributed in the pump delivery conduit 8 to injectors 5.

High-pressure pump 7 is in turn supplied by a low-pressure pump, e.g. a motor-driven pump 9, along a low-pressure fuel intake conduit 10. Motor-driven pump 9 is normally located in the fuel tank 11, to which a surplus-fuel drain conduit 12 of injection system 1 is connected. Drain conduit 12 drains into tank 11 both the surplus fuel drained by injectors 5, and any surplus fuel drained by common rail 6 when pressure exceeds that defined by a solenoid regulating valve 15. To control the delivery of pump 7, a regulating device comprising at least one on-off solenoid valve 27 is located between motor-driven pump 9 and high-pressure pump 7.

The fuel in tank 11 is at atmospheric pressure. In actual use, motor-driven pump 9 compresses the fuel to a low pressure, e.g. of around 2–3 bars; and high-pressure pump 7 compresses the incoming fuel from intake conduit 10 to supply high-pressure fuel, e.g. of about 1600 bars, along delivery conduit 8 to common rail 6. Each injector 5 is activated to inject corresponding cylinder 3 with a variable amount of fuel, i.e. ranging between a minimum and maximum value, under the control of an electronic control unit 16, which may be defined by the central microprocessor control unit of engine 2.

Control unit 16 receives signals indicating the operating conditions of engine 2, such as the accelerator pedal position and the speed of drive shaft 4, which are detected by corresponding sensors, and the fuel pressure in common rail 6 as detected by a pressure sensor 17. Control unit 16 processes the incoming signals by means of a special program to control when and for how long individual injectors 5 are to operate, as well as solenoid regulating valve 15.

High-pressure pump 7 comprises one or more reciprocating pumping elements 18, each defined by a cylinder 19 having a compression chamber 20, in which a piston 21 slides. Compression chamber 20 communicates with intake conduit 10 via an intake valve 25, and communicates with delivery conduit 8 via a delivery valve 30. Piston 21 is activated, by cam means 22 fitted to a shaft 23, to perform a reciprocating sinusoidal movement comprising an intake stroke and a compression or delivery stroke, as explained in detail later on.

In the FIG. 1 example, i.e. of a pump 7 with two pumping elements 18 controlled by a cam 22, and with a compression stroke by each pumping element 18 for each revolution of shaft 23 of pump 7, shaft 23 is connected to the drive shaft 4 by a transmission device 26, so that a compression stroke is performed for each injection by injectors 5 into respective cylinders 3. In a four-stroke engine 2, therefore, the rotation speed of shaft 23 of pump 7 equals the rotation speed of shaft 4 of engine 2 (transmission ratio=1). Shaft 23 may be defined by a shaft for also operating other devices of engine 2.

In engines with four or more cylinders, pump 7 normally comprises a number of pumping elements 18, which may be activated by a common cam. In the FIG. 1 embodiment, pump 7 comprises two diametrically opposite pumping elements 18 activated by a common cam 22.

Figure 3:
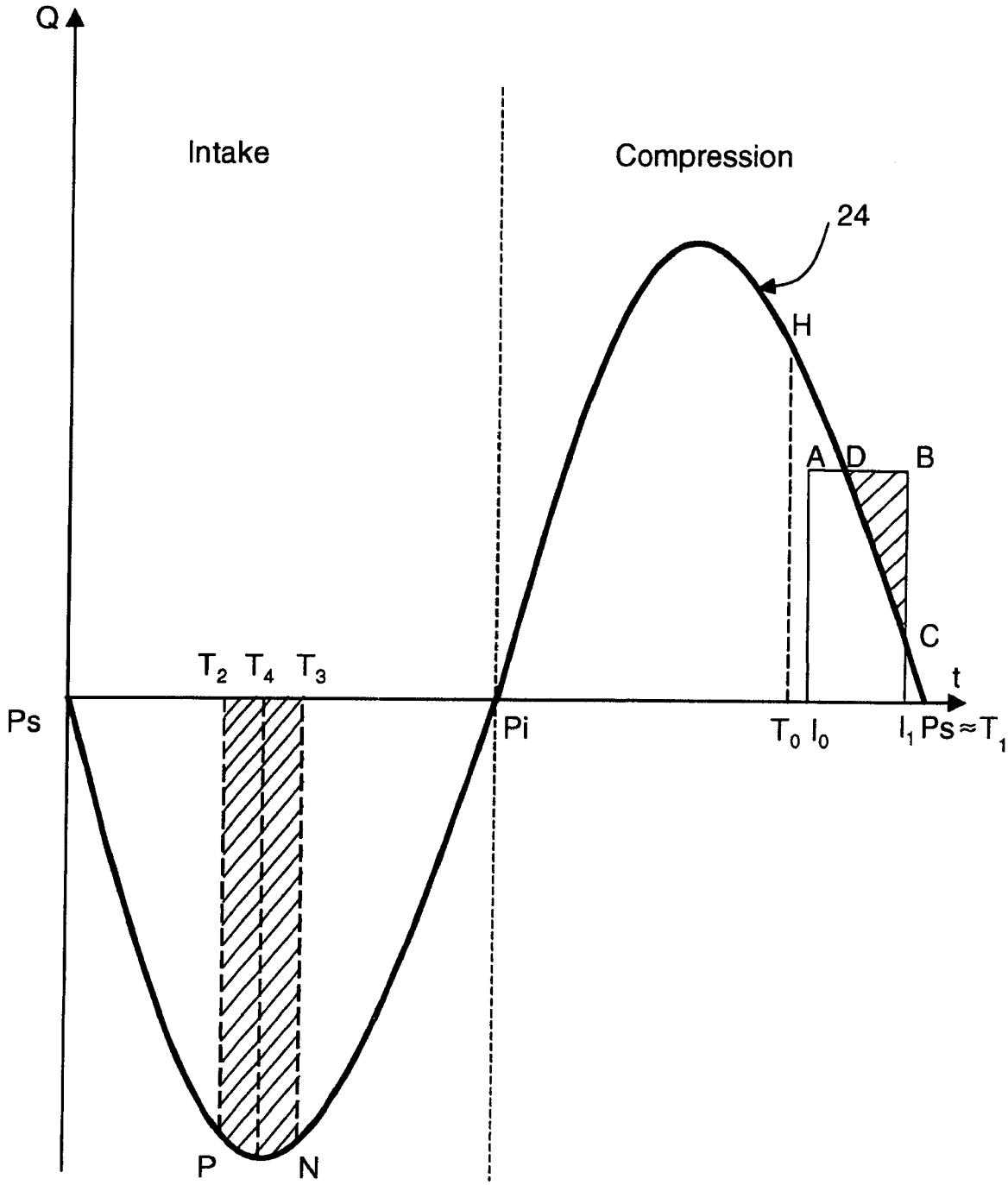
FIG. 3 shows an operating graph of the injection system in FIGS. 1 and 2.

In the FIG. 3 graph, the x axis shows the intake stroke Ps-Pi and the compression stroke Pi-Ps of a pumping element 18. The speed of pumping element 18 is shown by a sinusoidal curve 24, which therefore also represents the instantaneous flow Q of pumping element 18 in the absence of on-off solenoid valve 27. The area subtended by curve 24 therefore represents the maximum fuel intake/delivery volume for each pump stroke.

Operation of an injector 5 for each injection into respective cylinder 3 is represented by a rectangle $I_0ABI_1$, the base of which on the x axis is a segment between a start point $I_0$ and an end point $I_1$, and the height of which indicates the instantaneous flow (here assumed constant) of injector 5. The area of rectangle $I_0ABI_1$, therefore represents the volume of fuel delivered by injector 5 at the injection stage, and which varies both in duration, by varying the position of points $I_0$ and $I_1$, and by varying the instantaneous flow of the injector, i.e. the height of rectangle $I_0ABI_1$, e.g. by varying the fuel pressure in common rail 6.

Figure 4:
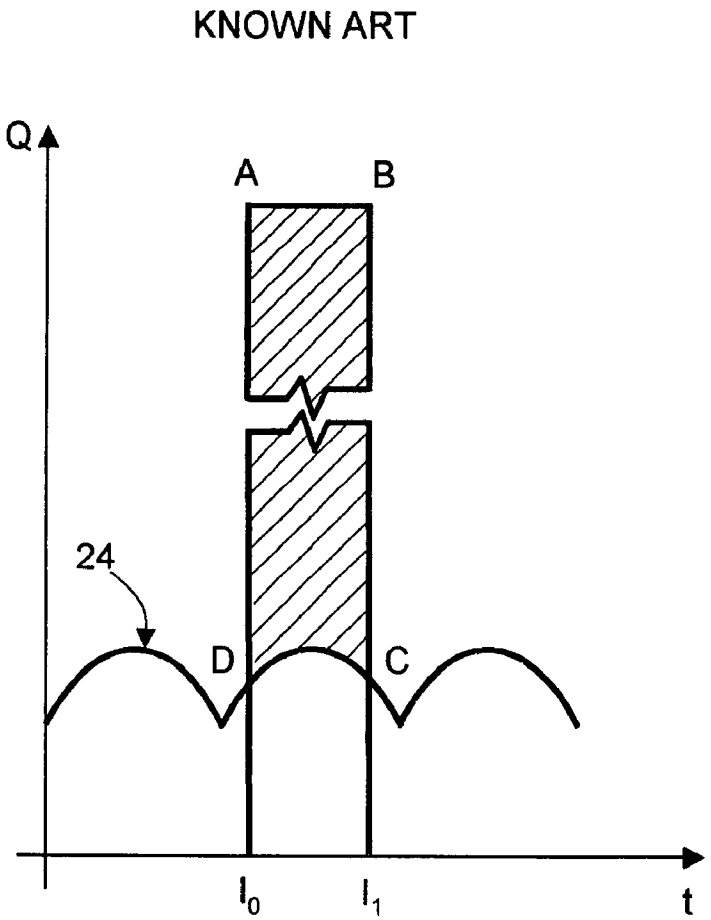
FIG. 4 shows an operating graph of a known injection system.

In known technology, as shown in the FIG. 4 graph, the volume of fuel $I_0DCI_1$, delivered by the pump during injection is only a fraction, e.g. about 20%, of the maximum flow of injector 5, so that, in maximum load conditions of engine 2, the rest ABCD, i.e. the other 80% of the fuel volume to be injected, must be supplied by common rail 6. The volume of common rail 6 must therefore be considerable to avoid an excessive fall in pressure of the fuel inside it during each injection. 80% of the fuel must therefore be supplied to common rail 6 by further deliveries by pumping elements 18 in the time lapse between the end of the preceding injection and the start of the one shown in FIG. 4, in which the pump, for example, comprises three pumping elements 18 operating continually at the maximum flow rate.

According to the invention, the maximum instantaneous flow of pumping element 18 is greater than the maximum flow of each injector 5, and may advantageously be over 150%, e.g. may range between 150% and 250%, of the maximum flow of injector 5.

The compression stroke Pi-Ps of pumping element 18 is performed synchronously with injection by injector 5. On-off solenoid valve 27 in turn is chopper-controlled by control unit 16, advantageously by means of corresponding software. During the intake stroke Ps-Pi, control unit 16 controls on-off solenoid valve 27 between an opening, i.e. intake start, instant $T_2$, and a closing, i.e. intake end, instant $T_3$. More specifically, control unit 16 controls solenoid valve 27 by a Pulse Width Modulation (PWM) logic signal and at a frequency related to the speed of shaft 23 of pump 7. During intake stroke Ps-Pi, on-off solenoid valve 27 feeds into compression chamber 20, in the interval $T_2$-$T_3$, a predetermined volume $T_2T_3NP$ of fuel—where area $T_2T_3NP$ is equivalent to area $T_0HPs$ in FIG. 3—which varies as a function of both the width and time location of interval $T_2$-$T_3$, and is proportional to the head produced by motor-driven pump 9.

As soon as suction valve 25 is closed by its spring to end suction stroke Ps-Pi, both the vapour and liquid fuel phases are present in compression chamber 20. During the first portion Pi-$T_0$ of compression stroke Pi-Ps, delivery valve 30 remains closed, on account of the compressibility of the fuel vapour introduced previously, and opens at instant $T_0$, when the vapour phase is no longer present and the liquid phase fuel pressure exceeds the fuel pressure in delivery conduit 8.

Pump 7 therefore only delivers during portion $T_0$-$T_1$, of the compression stroke of each pumping element 18. Since the work performed by pumping element 18 to compress the vapour in the initial portion of compression stroke Pi-$T_0$ is negligible, pump 7 dissipates very little energy. The volume $T_2T_3$NP of fuel introduced during the intake stroke by solenoid valve 27 therefore unequivocally defines delivery start instant $T_0$, and is selected as a function of the operating conditions of engine 2, i.e. the flow demanded by injectors 5.

Control unit 16 therefore chopper-modulates delivery of pumping elements 18, and controls opening of solenoid valve 27 by modulating both intake start instant $T_2$ and intake end instant $T_3$, so as to supply compression chamber 20 with a volume of fluid (area $T_2T_3$NP in FIG. 3) unequivocally defining delivery start instant $T_0$. The volume of fluid supplied to delivery conduit 8 (area $T_0HT_1$, in FIG. 3) is therefore just slightly greater than the fuel to be injected by injector 5 in the corresponding injection (area $I_0ABI_1$, in FIG. 3). Common rail 6 therefore only has to supply a minimum amount of fuel (area DBC in FIG. 3) during injection, so that, despite the small storage volume of common rail 6, the pressure in it remains more or less constant. As such, common rail 6 may be made small or even of the same volume as high-pressure conduit 8, since the fuel drawn from the common rail is almost totally and simultaneously replaced during the same injection.

More specifically, opening and closing instants $T_2$ and $T_3$ of solenoid valve 27 correspond to two intermediate points in the intake stroke of pumping element 18, and may advantageously be barycentric with respect to an instant $T_4$, in which pumping element 18 is at maximum speed and the depression in chamber 20 is therefore maximum. Instant $T_0$, on the other hand, corresponds to an intermediate point in the compression stroke of pumping element 18, which is slightly in advance of injection start instant $I_0$, so that area $T_0HDAI_0$ substantially equals area DBC.

Figure 2:
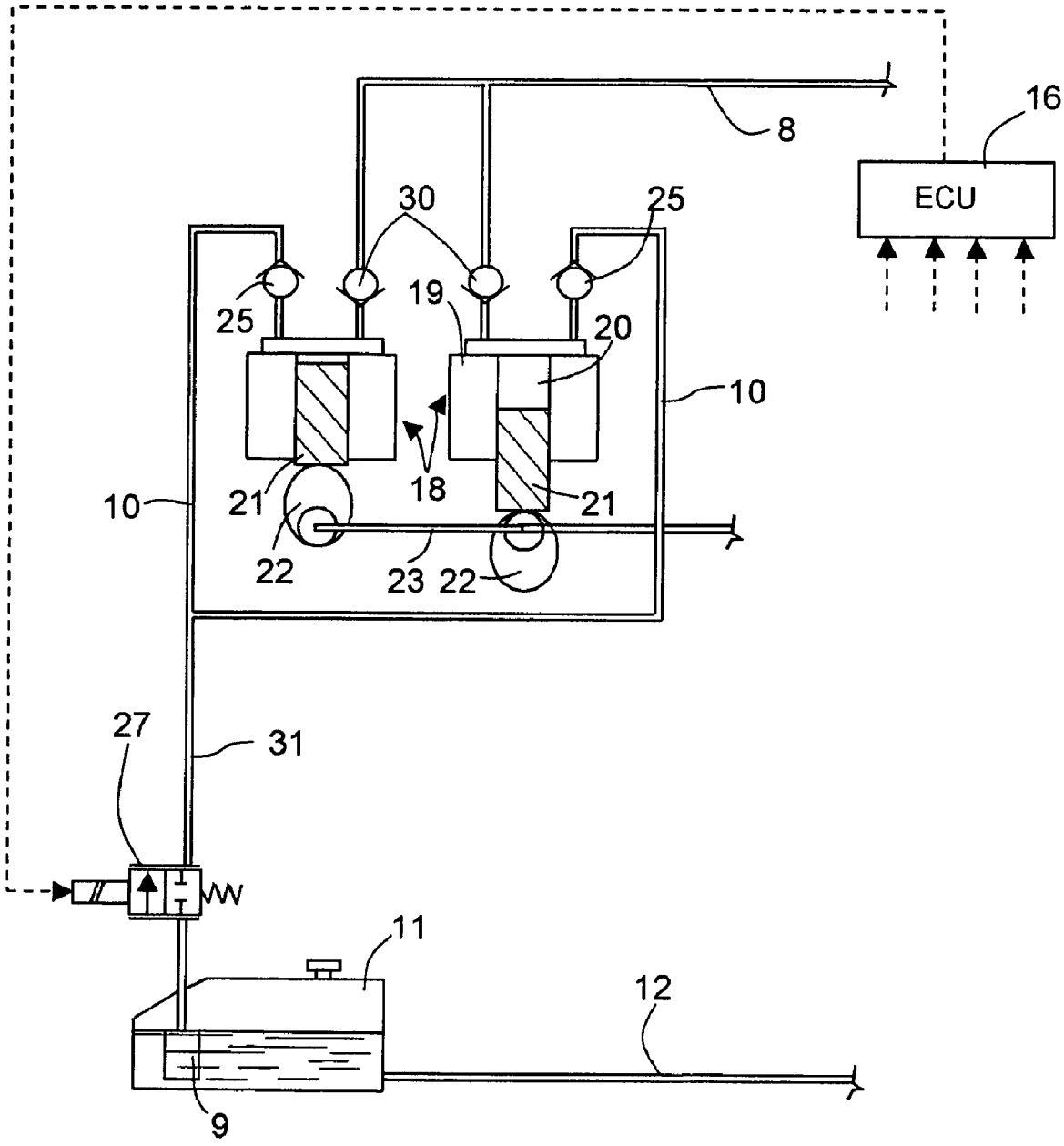
FIG. 2 shows a detail of a variation of the injection system according to the invention.

In the FIG. 2 embodiment, the two pumping elements 18 are arranged in line and activated by two cams 22 fixed in diametrically opposite positions to shaft 23; and on-off solenoid valve 27 is again fitted to a portion 31 of intake conduit 10 common to both pumping elements.

The injection system described above therefore provides for a method of controlling the fuel pressure in storage volume 6, whereby fuel is supplied by at least one reciprocating pumping element 18 performing a compression stroke, the control method being characterized by comprising the steps of:

- providing a pumping element 18 with a maximum instantaneous flow greater than the maximum instantaneous flow of an injection by each injector 5;
- providing an on-off solenoid valve 27 along an intake conduit 10 of said pumping element 18;
- activating the pumping element 18 synchronously with said injection; and
- controlling said on-off solenoid valve 27 during the intake stroke of the pumping element 18, so as to supply a predetermined fuel volume unequivocally defining the delivery start instant $T_0$.

The amount of fuel supplied by common rail 6 to each injector 5 at each injection is thus reduced.

The advantages, as compared with known systems, of the injection system according to the invention will be clear from the foregoing description. In particular, common rail 6 may be made very small or even eliminated, with obvious benefits as regards layout of the injection system in the engine compartment.

Clearly, further changes may be made to the injection system described with reference to FIGS. 1 and 2, without, however, departing from the scope of the accompanying claims. For example, each pumping element 18 of pump 7 may be provided with its own on-off solenoid valve 27 on the relative intake conduit; interval $T_2$-$T_3$ may be located anywhere within intake stroke Ps-Pi; on-off solenoid valve 27 may be integrated with pump 7, which in turn may even be defined by one pumping element 18; and pump 7 may even be defined by a pump with three or more radial pumping elements, and be used in other than four-cylinder engines.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A storage-volume fuel injection system for an internal combustion engine having a plurality of cylinders, the injection system comprising:

a pump for supplying high-pressure fuel to a storage volume, and a plurality of injectors supplied by said storage volume and each activated to perform an injection of pressurized fuel into a corresponding cylinder of the engine, said injection having a maximum pressurized fuel flow depending on the operating conditions of the engine;

said pump having at least one reciprocating pumping element performing an intake stroke and a compression stroke for each of said injections, said pumping element having a maximum instantaneous flow greater than the maximum flow of each of said injectors; and a control device being provided to vary the quantity of fuel supplied by said pump to the storage volume, said control device including an on-off solenoid valve located along the intake conduit of said pumping element, said on-off solenoid valve being pulse width modulation controlled by a chopper control unit synchronously with said intake stroke to introduce into the compression chamber of said pumping element a fuel volume unequivocally defined, for a predetermined rotation speed of said pump, by an opening instant and a closing instant of said on-off solenoid valve during said intake stroke.

2. The injection system as claimed in claim 1, wherein said fuel volume unequivocally defines the delivery start instant in said compression stroke, said fuel volume being selected as a function of operating conditions of the engine, and the end of an intake instant coinciding with the end of said compression stroke.

3. The injection system as claimed in claim 2, wherein delivery is substantially simultaneous with said injection.

4. The injection system as claimed in claim 2, wherein the maximum instantaneous flow of said pumping element is at least 150% of said maximum flow of the injector.

5. The injection system as claimed in claim 1, wherein said pump includes at least two pumping elements, each having a compression chamber communicating with a common intake conduit, said on-off solenoid valve being located along said intake conduit.

6. The injection system as claimed in claim 5, wherein said pumping elements are coaxial and opposite, and are activated by a common cam.

7. The injection system as claimed in claim 5, wherein said pumping elements are parallel, and are activated by two corresponding cams.

8. The injection system as claimed in claim 6, wherein each pumping element is associated with a corresponding on-off solenoid valve, each of said on-off solenoid valves being located along the intake conduit of the respective pumping element.

9. A high-pressure pump for supplying fuel to a storage volume for supplying a number of fuel injectors, said pump comprising:

at least one reciprocating pumping element performing an intake stroke and a compression stroke for an injection, said pumping element having a compression chamber communicating with an intake conduit and a delivery conduit, said pumping element having a maximum instantaneous flow greater than the maximum flow of each of said injectors; and an on-off solenoid valve being provided along said intake conduit to control the amount of fuel introduced into the compression chamber of said pumping element, said on-off solenoid valve being controlled to unequivocally define the fuel volume introduced into said compression chamber and consequently the delivery start instant of said pumping element; and a chopper control unit pulse width modulation controlling said on-off solenoid valve, said unequivocally defined fuel volume being defined, for a predetermined rotation speed of said pump, by an opening instant and a closing instant of said on-off solenoid valve during said intake stroke.

10. The high-pressure pump as claimed in claim 9, wherein said on-off solenoid valve is controlled synchronously with said injection.

11. A method of controlling the fuel pressure in a storage volume for at least one fuel injector of an internal combustion engine in which fuel is supplied to the storage volume by at least one reciprocating pumping element performing an intake stroke and a compression stroke, said method comprising the steps of:

providing a pumping element having a flow greater than the maximum flow of said injector;

providing an on-off solenoid valve along an intake conduit of said pumping element;

activating said pumping element synchronously with each of said injections; and controlling said on-off solenoid valve to modulate the fuel volume introduced into the pumping compression chamber during the intake stroke, and consequently the delivery start instant of said pumping element, said step of controlling including pulse width modulation (PWM) control of said on-off solenoid valve by a chopper control unit to introduce into the compression chamber of said pumping element a fuel volume unequivocally defined, for a predetermined rotation speed of said pump, by an opening instant and a closing instant of said on-off solenoid valve during said intake stroke.

12. The injection system as claimed in claim 3, wherein the maximum instantaneous flow of said pumping element is at least 150% of said maximum flow of the injector.

13. The injection system as claimed in claim 1, wherein said pump includes at least two pumping elements, each having a compression chamber communicating with a common intake conduit, said on-off solenoid valve being located along said intake conduit.

14. The injection system as claimed in claim 2, wherein said pump includes at least two pumping element, each having a compression chamber communicating with a common intake conduit, said on-off solenoid valve being located along said intake conduit.

15. The injection system as claimed in claim 3, wherein said pump includes at least two pumping elements, each having a compression chamber communicating with a common intake conduit, said on-off solenoid valve being located along said intake conduit.

16. The injection system as claimed in claim 4, wherein said pump includes at least two pumping elements, each having a compression chamber communicating with a common intake conduit, said on-off solenoid valve being located along said intake conduit.

17. The injection system as claimed in claim 7, wherein each pumping element is associated with a corresponding on-off solenoid valve, each of said on-off solenoid valves being located along the intake conduit of the respective pumping element.

* * * * *